US008768671B2

(12) United States Patent
Lee et al.

(10) Patent No.: US 8,768,671 B2
(45) Date of Patent: Jul. 1, 2014

(54) SYSTEM FOR OPTIMIZING A DRILLING OPERATION AND METHOD FOR USING SAME

(75) Inventors: Donald W. Lee, Houston, TX (US); Jose Ignacio Adachi, Houston, TX (US); John R. Waggoner, Katy, TX (US); Carmen Elena Alvarez, Missouri City, TX (US); Jorge Aurelio Santa Cruz Pastor, Rio de Janeiro (BR)

(73) Assignee: Schlumberger Technology Corporation, Sugar Land, TX (US)

( * ) Notice: Subject to any disclaimer, the term of this patent is extended or adjusted under 35 U.S.C. 154(b) by 471 days.

(21) Appl. No.: 12/885,925

(22) Filed: Sep. 20, 2010

(65) Prior Publication Data

US 2011/0264429 A1 Oct. 27, 2011

Related U.S. Application Data

(60) Provisional application No. 61/327,926, filed on Apr. 26, 2010.

(51) Int. Cl.
*G06G 7/48* (2006.01)

(52) U.S. Cl.
USPC ..... 703/10

(58) Field of Classification Search
USPC ..... 703/10
See application file for complete search history.

(56) References Cited

U.S. PATENT DOCUMENTS

| | | | |
|---|---|---|---|
| 5,982,707 | A | 11/1999 | Abbott |
| 6,014,343 | A | 1/2000 | Graf et al. |
| 6,138,076 | A | 10/2000 | Graf et al. |
| 2004/0122640 | A1 | 6/2004 | Dusterhoft |
| 2008/0065252 | A1 | 3/2008 | Hashimoto et al. |
| 2008/0201079 | A1 | 8/2008 | Castillo et al. |
| 2009/0065252 | A1 | 3/2009 | Moos et al. |
| 2009/0157319 | A1 | 6/2009 | Mitchell |

FOREIGN PATENT DOCUMENTS

| | | | |
|---|---|---|---|
| GB | 2479989 | | 11/2011 |
| GB | 2479989 | A | 11/2011 |
| WO | WO2008022124 | A1 | 2/2008 |
| WO | 2009021010 | | 2/2009 |
| WO | WO2009021010 | A2 | 2/2009 |
| WO | WO2010053618 | A1 | 5/2010 |
| WO | WO2010080270 | A1 | 7/2010 |

OTHER PUBLICATIONS

Moos et al.; Comprehensive wellbore stability analysis utilizing Quantitative Risk Assessment; Journal of Petroleum Science and Engineering 38 (2003) 97-109.*

(Continued)

*Primary Examiner* — Hugh Jones

(57) ABSTRACT

A system and method for optimizing a drilling operation is provided. The system has a drilling a drilling operation optimization unit. The drilling operation optimization unit has a base model unit for producing a base model of the reservoir and a reservoir stress unit for producing a three dimensional stress model of the reservoir. The drilling operation optimization unit has a trajectory unit for determining at least one property for at least one wellbore trajectory based on the base model and the three dimensional stress model, wherein each of the wellbore trajectories is selectable by an operator. The system has an operator station for inputting data into the drilling operation optimization unit at the wellsite and a drilling tool for forming a wellbore along at least one of the at least one selected wellbore trajectories.

21 Claims, 6 Drawing Sheets

(56) References Cited

OTHER PUBLICATIONS

Combined Search and Examination Report from counterpart GB Application No. GB1106835.0, dated Jun. 1, 2011, 7 pages.
Response to Combined Search and Examination Report for counterpart GB Application No. GB1106835.0, dated Apr. 26, 2012, 5 pages.
Office Action from counterpart GB Application No. GB1106835.0, dated Jul. 3, 2012, 2 pages.
Exam Report to United Kingdom Patent Application No. GB1106835.0 dated Dec. 10, 2012 (3 pages).
"What's New in Petrel 2010, Basin-to-prospect scalability, modeling while interpreting, and comprehensive risk analysis," Schlumberger 2010 (4 pages).
"Integration, usability, and repeatability from exploration to development," Schlumberger 2010 (4 pages).
Ahmed, K. et al, SPE 120219 brochure, "Prediction of Wellbore Stability Using 3D Finite Element Model in a Shallow Unconsolidated Heavy-Oil Sand in a Kuwait Field", (2009), 15 pages.
Plumb, R. et al., IADC/SPE 59128 brochure, "The Mechanical Earth Model Concept and Its Application to High-Risk Well Contstruction Projects", (2000), 13 pages.
Koutsabeloulis, N., SPE 126095, "3D Reservoir Geomechanical Modeling in Oil/Gas Field Production", (2009), 14 pages.
Pretrel 2009—What's New brochure, "Realize the Power of Petrel 2009 Seismic to Stimulation Software", Schlumberger (2009), 4 pages.
Doornhof, D. et al, "Compaction and Subsidence", (2006), 19 pages.
Sayers, C. et al., SPE 103926 brochure, Predicting Reservoir Compaction and Casing Deformation in Deepwater Turbidiites Using a 3D Mechanical Earth Model, (2006), 7 pages.
Koutsabeloulis, N. & Zhang, X., "3D Coupled Geomechanical Modeling in Reservoir Management", (2009), 15 pages.
Schlumberger Pretrel 2009—What's New brochure, "Realize the Power of Petrel 2009 Seismic to Stimulation Software", (2009), 4 pages.
Last et al., "SPE 30464: An Integrated Approach to Evaluating and Managing Wellbore Instability in the Cusiana Field, Columbia, South America," SPE International, 1995: pp. 147-160.

* cited by examiner

SYSTEM FOR OPTIMIZING A DRILLING OPERATION AND METHOD FOR USING SAME

CROSS-REFERENCE TO RELATED APPLICATION

This application claims the benefit of U.S. Provisional Application No. 61/327,926 filed Apr. 26, 2010.

BACKGROUND

The invention relates to techniques for performing oilfield operations relating to subterranean formations having reservoirs therein. More particularly, the invention relates to techniques for optimizing a wellbore based on a reservoir stress model, for example, determining a wellbore design parameter for a wellbore trajectory from the reservoir stress model.

Oilfield operations are typically performed to locate and gather valuable downhole fluids from a reservoir. Typical oilfield operations may involve, for example, surveying, seismic testing, drilling, wireline testing, completions, production, planning, and oilfield analysis. Drilling operations may involve drilling a wellbore, pumping a mud into the wellbore, and the like. Developing a strategy for well (or wellbore) placement, may involve an examination of the safe mud weight window for drilling the well. The safe mud weight window may be a weight of drilling mud used during drilling operation. The safe mud weight window may vary for each trajectory and may be determined for each specific well trajectory by first doing a detailed analysis of an existing drilled wellbore. From the existing wellbore, a geomechanics expert may analyze and calculate the wellbore stability for the planned wellbore. From the wellbore stability of the existing wellbore, the geomechanics expert may determine a safe mud weight window. The calculations typically used to determine the wellbore stability may be complex and may require an expert to work weeks or months processing the information for each of the formed wellbores.

Base models of reservoirs have been formed to determine risks and properties of the reservoir, such as drilling hazards, and potential hydrocarbons. Examples of base models and methods of forming base models are described in U.S. Pat. Nos. 5,982,707, 6,014,343, and 6,138,076 the entire contents of which are herein incorporated by reference.

Despite the existence of techniques for forming base models and determining a safe mud weight window for an existing wellbore, there remains a need to optimize a drilling operation quickly by determining properties for a potential trajectory. It is desirable that such techniques take into consideration the reservoir stress properties prior to completing the wellbore. It is further desirable that such techniques determine wellbore properties for one or more potential trajectories and compare the properties to optimize the wellbore(s) to be formed along the trajectories. Such techniques are preferably capable of one or more of the following, among others: reducing formation damage, minimizing sand optimizing production, reducing costs, reducing risks, reducing uncertainties, collecting data in real time, analyzing data in real time, updating operations in real time, adjusting operations in real time, providing a reliable analysis, and providing efficient data acquisition.

SUMMARY

The invention relates to a drilling operation optimization unit for determining at least one property of at least one wellbore trajectory in a reservoir at a wellsite. The drilling operation optimization unit has a base model unit for producing a base model of the reservoir, a reservoir stress unit for producing a three dimensional stress model of the reservoir. The drilling operation optimization unit has a trajectory unit for determining at least one property for at least one wellbore trajectory based on the base model and the three dimensional stress model, wherein each of the wellbore trajectories is selectable by an operator.

The invention relates to a system for optimizing a drilling operation for a reservoir at a wellsite. The system has a drilling operation optimization unit. The drilling operation optimization unit has a base model unit for producing a base model of the reservoir and a reservoir stress unit for producing a three dimensional stress model of the reservoir. The drilling operation optimization unit has a trajectory unit for determining at least one property for at least one wellbore trajectory based on the base model and the three dimensional stress model. Each of the wellbore trajectories is selectable by an operator. The system has an operator station for inputting data into the drilling operation optimization unit at the wellsite. The system has a drilling tool for forming a wellbore along at least one of the at least one selected wellbore trajectories.

The invention relates to a method for optimizing a drilling operation in a reservoir at a wellsite. The method comprises providing a drilling operation optimization unit. The drilling operation optimization unit has a base model unit for producing a base model of the reservoir and a reservoir stress unit for producing a three dimensional stress model of the reservoir. The drilling operation optimization unit has a trajectory unit for determining at least one property for at least one wellbore trajectory based on the base model and the three dimensional stress model, wherein each of the wellbore trajectories is selectable by an operator. The method comprises constructing a consolidated model of the reservoir, the consolidated model having a reservoir stress model and selecting the at least one wellbore trajectory. The method comprises determining at least one property of the wellbore trajectory using the consolidated model and determining at least one design parameter for a wellbore to be formed along at least one of the at least one wellbore trajectories.

BRIEF DESCRIPTION OF THE DRAWINGS

The embodiments may be better understood, and numerous objects, features, and advantages made apparent to those skilled in the art by referencing the accompanying drawings. These drawings are used to illustrate only typical embodiments of this invention, and are not to be considered limiting of its scope, for the invention may admit to other equally effective embodiments. The figures are not necessarily to scale and certain features and certain views of the figures may be shown exaggerated in scale or in schematic in the interest of clarity and conciseness.

DESCRIPTION OF EMBODIMENT(S)

The description that follows comprises exemplary apparatus, methods, techniques, and instruction sequences that embody techniques of the inventive subject matter. However, it is understood that the described embodiments may be practiced without these specific details.

Figure 1:
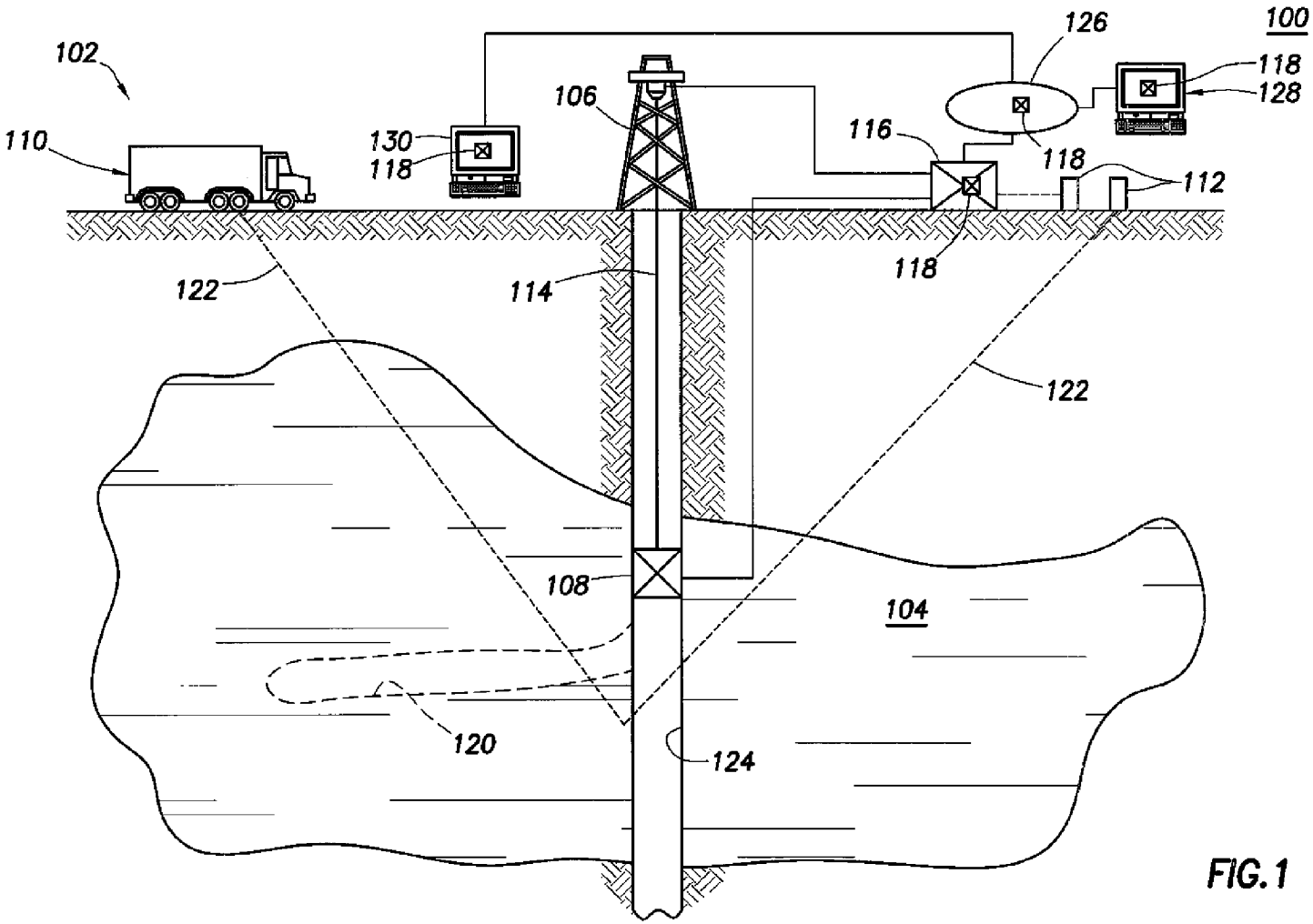
FIG. 1 is a schematic diagram depicting a wellsite having a system for optimizing a drilling operation during an information gathering phase.

FIG. 1 shows a schematic diagram depicting a wellsite 100 having a drilling operation optimization system 102 during an information gathering stage, or data audit. As shown, the wellsite 100 is a land based wellsite 100, but could also be water based. The wellsite 100 may have a reservoir 104, which may contain valuable fluids (such as hydrocarbons) to be produced. The wellsite 100 may be in the information gathering phase prior to the production of the reservoir 104. The wellsite 100 may have wellsite equipment for gathering information about the wellsite 100 and/or the reservoir 104 such as a rig 106, a logging tool 108, a seismic wave inducing tool 110, one or more receivers 112, a conveyance 114, and a controller 116. The controller 116 may have a drilling operation optimization unit 118. The drilling operation optimization unit 118 may optimize one or more production wellbores 120, or wellbores, as will be described in more detail below.

The wellsite 100 may be surveyed, tested, and/or analyzed to determine information regarding the reservoir 104 during the information gathering stage. For example, the seismic wave inducing tool 110 may survey the reservoir 104, using seismic waves 122 that may be detected by the receivers 112. One or more test wellbores 124, or existing offset wells, may be drilled into and/or through the reservoir 104 to allow the logging tool 108 to test, survey, sample, and/or analyze the reservoir 104. Further, any method for gathering information regarding the reservoir 104 may be used, such as using operator knowledge of the area, information from other wellsites (not shown) in the region, logging while drilling tools, and the like. The information gathered may be sent to the controller 116 and/or the drilling operation optimization unit 118 in order to optimize the one or more production wellbores 120, or wells, to be completed in the reservoir 104.

The controller 116 may send and receive data to and/or from any of the tools, devices and/or systems associated with the wellsite 100, such as the seismic wave inducing tool 110, the logging tool 108, the one or more receivers 112, a network 126, one or more offsite communication devices 128, a wellsite communication device 130 and/or any suitable equipment located about the wellsite 100. The drilling operation optimization system 102 may comprise the network 126 for communicating between the wellsite 100 components, systems, devices, and/or tools. Further, the network 126 may communicate with the one or more offsite communication devices 128 and the wellsite communication device 130, such as computers, personal digital assistants, and the like. The network 126 and/or the controller 116 may communicate with any of the tools, devices and systems, using any combination of communication devices or methods such as, wired, telemetry, wireless, fiber optics, acoustic, infrared, a local area network (LAN), a personal area network (PAN), and/or a wide area network (WAN), and the like. The connection may be made via the network 126 to an external computer (for example, through the Internet using an Internet Service Provider), and the like. The drilling operation optimization unit 118 may be partially and/or wholly located at the controller 116, the network 126, the offsite communication devices 128, and/or the wellsite communication device 130.

Figure 2:
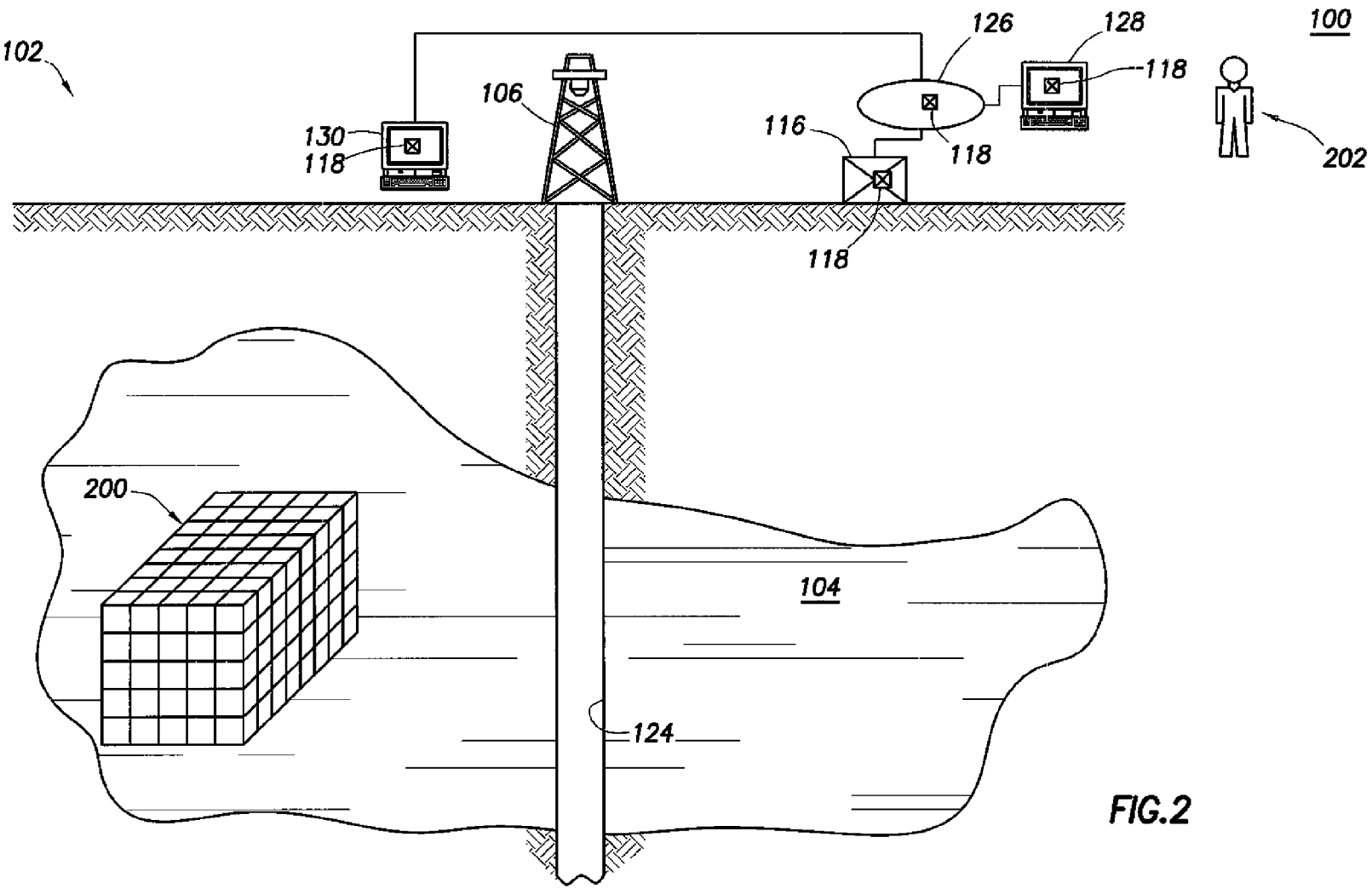
FIG. 2 is a schematic diagram depicting the wellsite having the system for optimizing the drilling operation during a model generation phase.

FIG. 2 shows a schematic diagram depicting the wellsite 100 having the drilling operation optimization system 102 of FIG. 1 during a model generation phase. From the information gathered, a consolidated model 200 may be generated for the reservoir 104. The consolidated model 200 may be constructed from a base model and a reservoir stress model for the reservoir 104, as will be described in more detail below. The consolidated model 200 may be constructed by the drilling operation optimization unit 118 and/or model personnel 202. The model personnel 202 may be one or more people with expertise in analyzing the information gathered regarding the reservoir 104 such as, a geologist, a geomechanics expert, a geophysicist, a reservoir engineer, a production specialist, and the like. The consolidated model 200 may be constructed for the reservoir 104, multiple reservoirs (not shown), and/or the entire field accessible from the wellsite 100.

Figure 3:
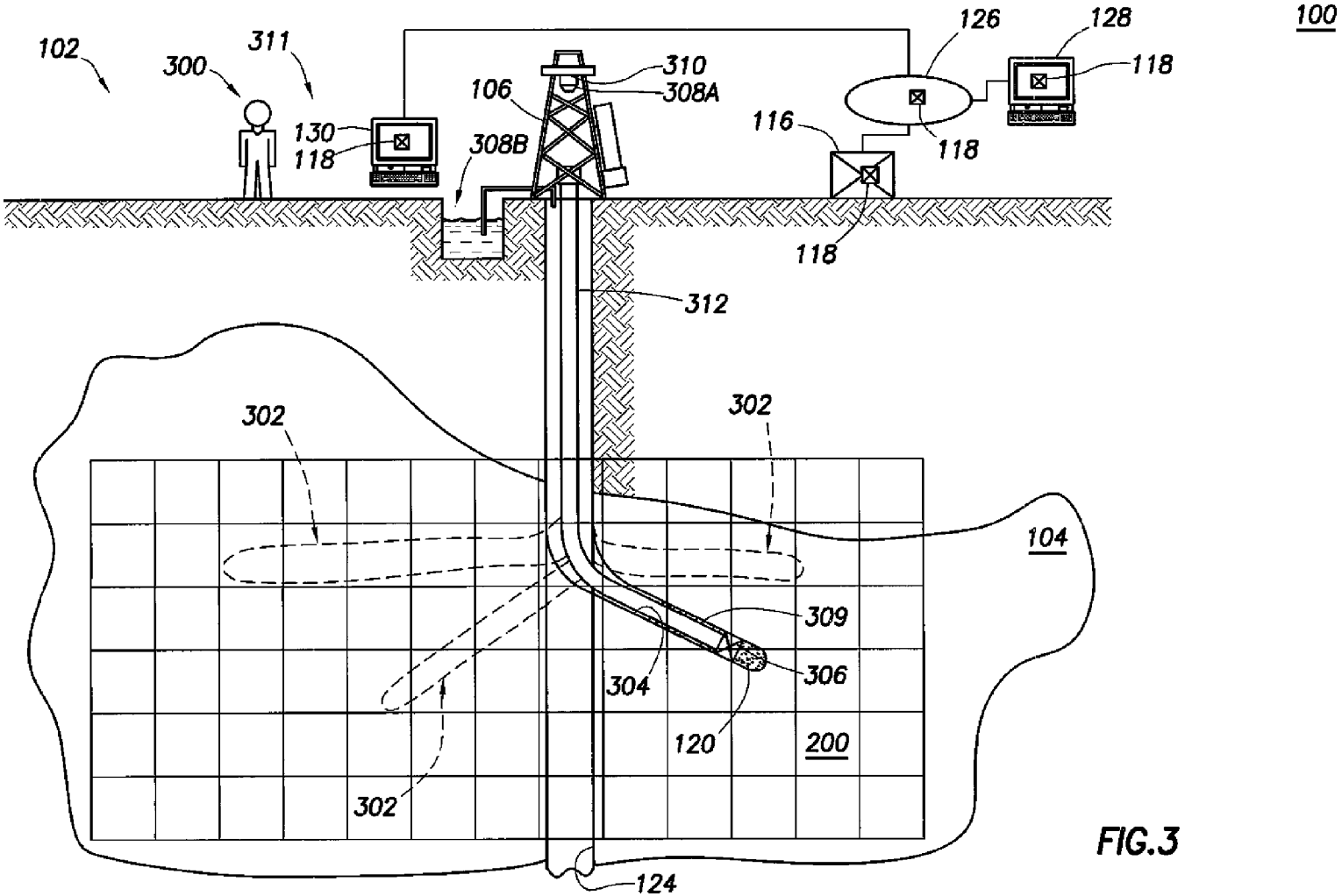
FIG. 3 is a schematic diagram depicting the wellsite having the system for optimizing the drilling operation during a pre-production phase.

FIG. 3 shows a schematic diagram depicting the wellsite 100 having the drilling operation optimization system 102 of FIG. 2 during a preproduction phase. The consolidated model 200 may have been constructed for the entire reservoir 104. The consolidated model 200 may be stored on the drilling operation optimization unit 118 for use by one or more operators 300. The operator 300 may be any personnel associated with the planning, drilling, completions, and/or production of the reservoir 104 at the wellsite 100. The operator 300 may be located proximate the rig 106 for example: on a rig floor, or an operator station 311, or at any other suitable location for the planning, drilling, completing, and/or production of the reservoir 104.

The operator 300 may evaluate one or more trajectories 302 prior to drilling the trajectories 302, using the drilling operation optimization unit 118. For example, the operator 300 may input several potential trajectories, or the trajectories 302, into the drilling operation optimization unit 300. The drilling operation optimization unit 118 may then determine one or more properties, such as wellbore stability, for each of the trajectories 302 based on the consolidated model 200, as will be described in more detail below. The drilling operation optimization unit 118 may determine for example, an optimal trajectory 304 by comparing each of the potential trajectories 302. The operator 300 may then drill the one or more production wellbores 120 based on the optimal trajectory 304.

The production wellbore(s) 120 may be formed using a drilling tool 306. The drilling tool 306 may have any number of instruments (not shown) for gathering data regarding the production wellbore during drilling. Further, any number of sensors, testers, and/or tools, such as the logging tool 108 (as shown in FIG. 1), may be deployed into the production wellbore 120 during drilling, completions, and/or production to gather information regarding the production wellbore 120. The information may be sent to the controller 116 and/or the drilling operation optimization unit 118.

The wellsite 100 may have a pumping system 308A and/or 308B, and/or cementing tool, for pumping a mud 309, and/or cement, into the production wellbore 120. The wellsite 100 may further have a hoisting system 310 for delivering the conveyance and/or a tubular string 312 into the production wellbore 120. The tubular string 312 may be a casing string, a drill string, a production tubing and the like. The drilling operation optimization unit 118, as will be described in more detail below, may select design parameters for the mud, the cement, the tubular string and the like.

Figure 4:
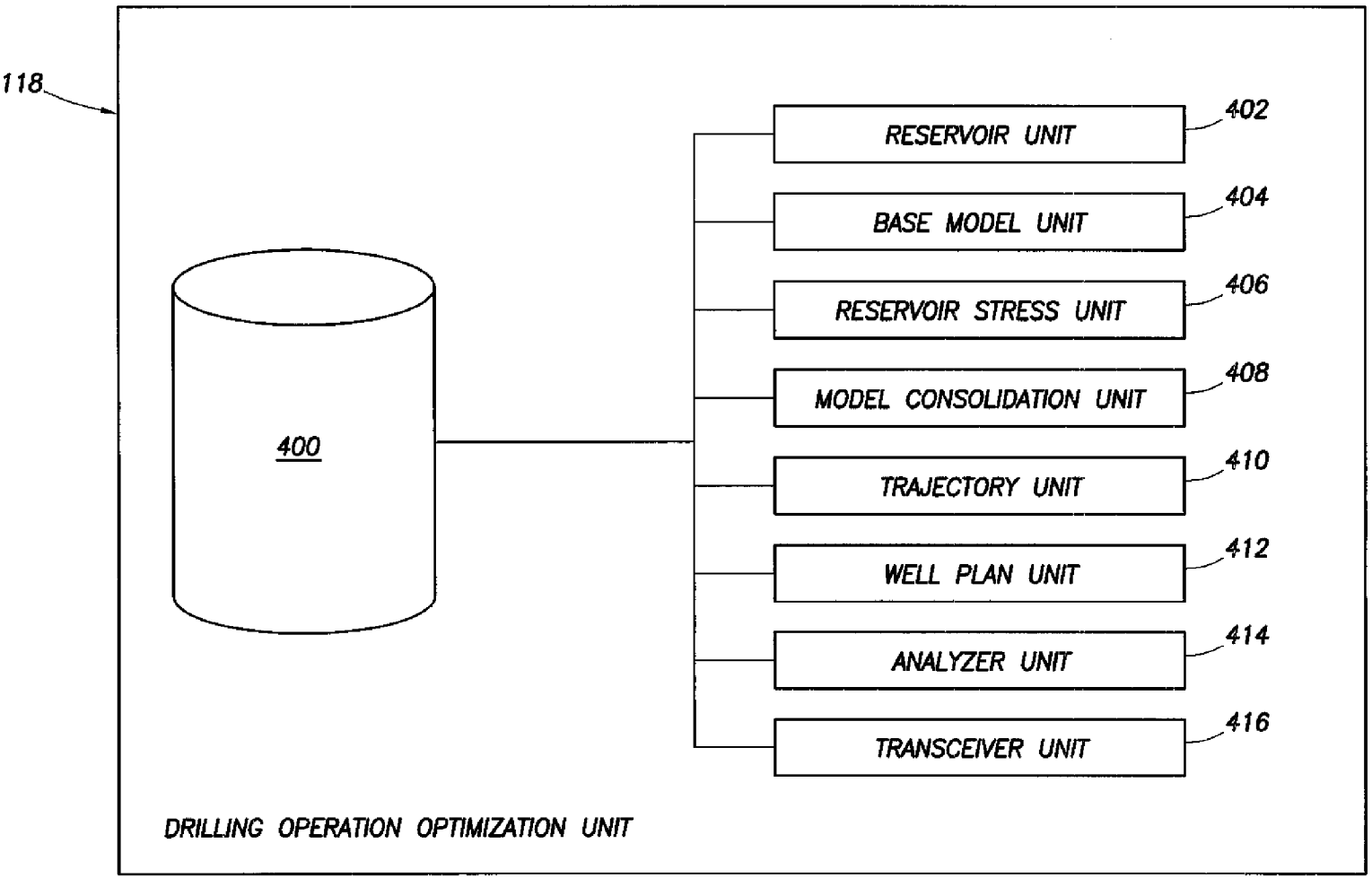
FIG. 4 depicts a block diagram illustrating a drilling operation optimization unit of the system of FIG. 1.

FIG. 4 depicts a block diagram illustrating the drilling operation optimization unit 118 usable with the drilling operation optimization system 102 of FIG. 1. The drilling operation optimization unit 118 may be incorporated into or about the wellsite 100 (on or off site) for operation with the controller 116. The drilling operation optimization unit 118 may model various parameters of the drilling operation optimization system 102 in order to optimize the production wellbores 120 formed in the reservoir 104. The drilling operation optimization unit 118 may form the consolidated model 200, determine properties of the trajectories 302 provided by the operator 300, and/or select the optimal trajectory 304 for the wellsite 100.

The drilling operation optimization unit 118 may take the form of an entirely hardware embodiment, an entirely software embodiment (including firmware, resident software, micro-code, etc.), or an embodiment combining software and hardware aspects. Embodiments may take the form of a computer program embodied in any medium having a computer usable program code embodied in the medium. The embodiments may be provided as a computer program product, or software, that may comprise a machine-readable medium having stored thereon instructions, which may be used to program a computer system (or other electronic device(s)) to perform a process. A machine readable medium comprises any mechanism for storing or transmitting information in a form (such as, software, processing application) readable by a machine (such as a computer). The machine-readable medium may comprise, but is not limited to, magnetic storage medium (e.g., floppy diskette); optical storage medium (e.g., CD-ROM); magneto-optical storage medium; read only memory (ROM); random access memory (RAM); erasable programmable memory (e.g., EPROM and EEPROM); flash memory; or other types of medium suitable for storing electronic instructions. Embodiments may further be embodied in an electrical, optical, acoustical or other form of propagated signal (e.g., carrier waves, infrared signals, digital signals, etc.), or wireline, wireless, or other communications medium. Further, it should be appreciated that the embodiments may take the form of hand calculations, and/or operator comparisons. To this end, the operator and/or engineer(s) may receive, manipulate, catalog and store the data from the drilling operation optimization system 102 in order to perform tasks depicted in the drilling operation optimization unit 118.

The drilling operation optimization unit 118 may have a storage device 400, a reservoir unit 402, a base model unit 404, a reservoir stress unit 406, a model consolidation unit 408, a trajectory unit 410, a well plan unit 412, an analyzer unit 414 and a transceiver unit 416. The storage device 400 may be any conventional database or other storage device capable of storing data associated with the drilling operation optimization system 102 shown in FIG. 1. Such data may comprise, for example, historical data, information gathered, one or more base models, one or more reservoir stress models, information regarding the trajectories, and the like. The analyzer unit 414 may be any conventional device, or system, for performing calculations, derivations, predictions, analysis, and interpolation, such as those described herein. The transceiver unit 416 may be any conventional communication device capable of passing signals (e.g., power, communication) to and from drilling operation optimization unit 118. The reservoir unit 402, the base model unit 404, the reservoir stress unit 406, the model consolidation unit 408, the trajectory unit 410, the well plan unit 412, may be used to receive, collect and catalog data, and/or to generate outputs, as will be described further below.

The reservoir unit 402 may obtain, manipulate, catalog, classify and quantify data about the reservoir 104 (as shown in FIGS. 1-3). The reservoir data may be obtained prior to drilling, during drilling, after drilling, during completions operations, and/or during the production life of the reservoir 104 and/or the production wellbore 120. The reservoir data may be sent to the drilling operation optimization unit 118 from multiple sources, such as from surveying equipment, well logging, well testing, production history of neighboring wells, operator knowledge of the area, seismic data, pressure data, temperature data, flow data, geomechanical expert data, and the like. The reservoir data may be obtained from any suitable device, tool, or personnel, about the wellsite 100, such as the logging tool 108, the seismic wave inducing tool 110, the one or more receivers 112, the one or more offsite communication devices 128 (as shown in FIG. 1), the model personnel 202 (as shown in FIG. 2), the operator 300, and the like. The reservoir data collected may be any number of reservoir 104 parameters, such as vertical stress (the weight of the overburden), pore pressure (pressure of fluids in rock pores), horizontal stresses, reservoir porosity, permeability, vertical permeability, lateral permeability, mechanical properties (Poisson's Ratio, Young's Modulus, etc.), and the like. Once the reservoir data has been cataloged and/or parameterized by the reservoir unit 402, a base model, and a reservoir stress model may be created.

The base model unit 404 may use the data collected by the reservoir unit 402 and/or model personnel 202 input, to build the base model of the reservoir 104. The base model may be a semi-analytic simulator that models the three dimensional (3D) properties of the reservoir based on the reservoir data. For example, the base model may be a geo-mechanical and material property model of the subsurface of the wellsite 100 and/or the reservoir 104 (as shown in FIGS. 1-3). The model may integrate the work of several of the model personnel 202. The base model may be any suitable reservoir model, such as the PETREL® software offered by the assignee of the present application, SCHLUMBERGER TECHNOLOGY CORPORATION™ of Sugar Land, Tex. The base model may identify any number of features of the reservoir 104, such as the framework of the reservoir, the drilling hazards, and the like.

The reservoir stress unit 406 may use the use data collected by the reservoir unit 402 and/or model personnel 202 input to build the reservoir stress model. The reservoir stress model may be formed by building a one dimensional (1D) Mechanical Earth Model (MEM) for the field, or reservoir 104 (as shown in FIGS. 1-3). The 1D MEM may evaluate the rock mechanical properties and stress properties at the test wellbore 124. The 1D MEM may evaluate Earth stresses (Pp, Sh, Sv, SH), the directions and magnitudes of the stresses, the rock mechanics properties (E, v, UCS, friction angle, and the like). Pp may represent the pore pressure, or pressure of fluids in the rock pores in the reservoir 104. Sh and SH may represent the horizontal stresses in the reservoir 104, for example, SH may represent the maximum horizontal effective stresses, while Sh may represent the minimal horizontal effective stresses. Sv may represent the magnitude of vertical stress, or the weight of the overburden, in the reservoir 104. The mechanical material properties may be the rock tensile strength, the rock compressive strength, Poisson's ratio, and/or Young's modulus (the static elastic properties). The model personnel 202 (as shown in FIG. 2) and/or the reservoir stress unit 406 may use any suitable techniques for identifying the natural fracture of the reservoir using, for example, seismic attributes, such as Amplitude Versus Angle and Azimuth (AZAZ) analysis.

The reservoir stress unit 406 and/or the model personnel 202 (as shown in FIG. 2) may propagate the properties from the 1D MEM to a 3D model using suitable statistical methods, for example, Kriging, Sequential Gaussian Simulation, thorough inversion of seismic properties and the like. The propagated 3D model may provide an estimate of the reservoir properties in the reservoir 104 for the area similar to the base model.

The reservoir stress unit 406 and/or the model personnel 202 may construct a finite element model to determine the 3D stress field for the reservoir 104 (as shown in FIGS. 1-3). The finite element model may account for the rock properties that may vary with location in the reservoir 104, such as the stresses, the pressures and the like. The finite element model may yield a 3D stress field of the reservoir 104 for the area similar to the base model. The finite element model may be performed using any suitable method, for example, a finite element calculator. The reservoir stress unit 406 may combine the 3D stress field (or the finite element model) with the 3D model. The combined model containing the 3D stress field and the 3D model may depict the properties of the reservoir 104, such as mechanical stratigraphy, overburden stress, pore pressure, rock strength, stress direction, minimum stress, maximum stress, and the like.

The model consolidation unit 408 may combine portions or all of the base model, the 1D MEM, 3D model and the 3D stress field to form a consolidated model of the reservoir 104 (as shown in FIGS. 1-3). The consolidated model may represent the properties of the reservoir 104 from all of the models. The consolidated model may predict and/or reflect the effect of drilling events on the reservoir properties, for example, wellbore stability. Constructing the base model, the 1D MEM, the 3D model, the 3D stress field may require the model personnel 202 (as shown in FIG. 2), for example a geomechanics expert, and/or the drilling operation optimization unit 118. These models may take several months to develop the equations, algorithms, and correlations between reservoir properties in order to allow the models to reflect the reservoir properties and responses to reservoir events, such as drilling events, completion events, production events, and the like. The expertise produced in these models may be combined in the consolidated model.

Once the consolidated model is formed and/or calibrated, the workflow may be reduced using the consolidated model. For example, the calibration equations, parameters, and the like may repeatedly determine properties of the potential trajectories 302 and/or the production wellbore 120 (as shown in FIG. 3). The properties may be any suitable wellbore property such as wellbore stability, porosity, stress, and the like. From the wellbore properties along the potential trajectories 302, the drilling operation optimization unit 118 may determine one or more wellbore design parameters, such as the safe mud weight, as will be discussed in more detail below. The consolidated model may have all the expertise of the model personnel 202 (as shown in FIG. 2) built into the consolidated model, thereby requiring minimal knowledge, or expertise from the operator 300.

The trajectory unit 410 may be used by the operator 300 (as shown in FIG. 3), or other wellbore personnel and/or designers to optimize the production wellbore 120 to be formed. The operator 300 may input the one or more potential trajectories 302 into the drilling operation optimization unit 118. The prior construction of the consolidated model incorporates the equations, parameters, and calibrations from the base model, the 1D MEM, the 3D model, and/or the 3D stress field for the entire reservoir 104; therefore, the operator 300 may only need to input the potential trajectories 302. The potential trajectories 302 may be inputted, based on the operator's 300 knowledge, the information gathered, geological target, and/or a combination thereof.

The trajectory unit 410 may determine the wellbore properties for each of the potential trajectories 302 using the consolidated model. Therefore, the operator 300 may instantaneously obtain wellbore properties for any potential trajectory 302 in the reservoir 104. The trajectory unit 410 may further compare the wellbore properties of each of the potential trajectories 302. The compared trajectories may be used to determine an optimal trajectory 304. The optimal trajectory 304 may be a trajectory based on any, or a combination of, goal(s) for the production of the reservoir 104. For example, the optimal trajectory 304 may be based on maximum production, minimal cost, effective reservoir drainage, avoidance of hazards, type of downhole equipment used, and the like.

The well plan unit 412 may determine a well plan for any of the trajectories 302 and/or the optimal trajectories 304 in the reservoir 104. The well plan unit 412 may determine wellbore design parameters to be used during the construction of the production wellbore 120. The wellbore design parameters, or drilling parameters, may be determined from the wellbore properties along the trajectories 302, and/or the optimal trajectory 304, as determined by the trajectory unit 410. The design parameters may be, for example, the safe mud weight determined from the wellbore stability, the safe mud weight window, cement weight, cement type, casing type, production tubing type, perforation method, casing point locations, the cost of the materials to be used, and the like. The safe mud weight may reduce wellbore instability and/or reduce mud loss due to rock failure. The well plan unit 412 may thus give the operator a well plan that provides the materials, equipment, and/or methods to be used during the drilling, the completion, and/or the production of the production wellbore 120. The mud weight is the weight of the drilling mud used during drilling. Determining the safe mud weight window may reduce wellbore instability and/or mud loss due to rock failures. Rock failures occurring around the wellbore may be dependent upon a number of factors, such as the rock strength, the pore pressure, the stresses in the rock, the wellbore deviation, the wellbore azimuth and the like. The safe mud weight window may typically be determined by analyzing an offset well to calibrate a model. The equations from the calibrated model may be transferred to a planned well trajectory. This process is repeated as each new trajectory is examined.

During the drilling, completions and/or the production of the production wellbore 120, additional data may be collected and sent to the drilling operation optimization unit 118. The drilling operation optimization unit 118 may update the consolidated model based on the additional data. The trajectory unit 410 and/or the well plan unit 412 may then update the well plan and/or the optimal trajectory based on the additional data obtained.

Figure 5:
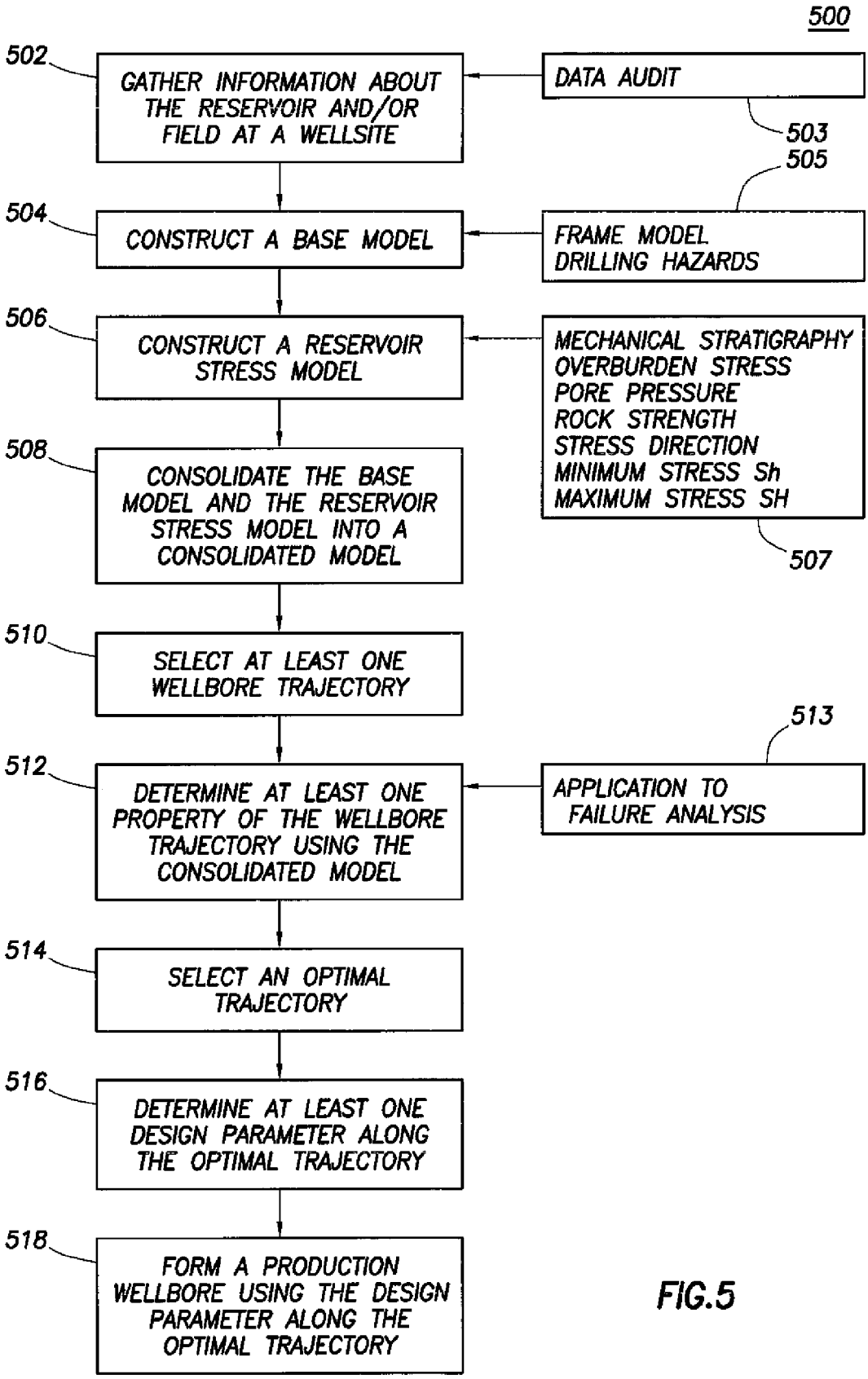
FIG. 5 is a flowchart depicting a method for optimizing the drilling operation.

FIG. 5 is a flowchart 500 depicting a method for optimizing a wellbore in a reservoir 104 (as shown in FIGS. 1-3). The method starts by gathering 502 information about the reservoir 104 and/or the field at the wellsite 100. The information gathering stage may be performed using suitable methods, such as those described herein. A data audit 503 may be performed on the information gathered from the wellsite. The method continues by constructing 504 a base model. The base model may be used to determine any number of reservoir and/or wellsite parameters, for example, the base model may determine 505 a framework model, drilling hazards, and/or the like. The method continues by constructing 506 a reservoir stress model. The reservoir stress model may be used to determine 507 any number of reservoir and/or wellbore parameters, for example, the mechanical stratigraphy, the overburden stress, the pore pressure, the rock strength, the stress direction, the minimum stress Sh, the maximum stress SH, and the like.

The method continues by consolidating 508 the base model and the reservoir stress model into a consolidated model and selecting 510 at least one wellbore trajectory. The method continues by determining 512 at least one property of the wellbore trajectory using the consolidated model. The determining 512 of the at least one property may apply 513 failure analysis to the wellbore trajectory. The method continues by selecting 514 an optimal trajectory and determining 516 at least one design parameter along the optimal trajectory. The method may continue by forming 518 the production wellbore using the design parameter along the optimal trajectory. The steps may be performed in other orders and/or repeated as desired.

Figure 6:
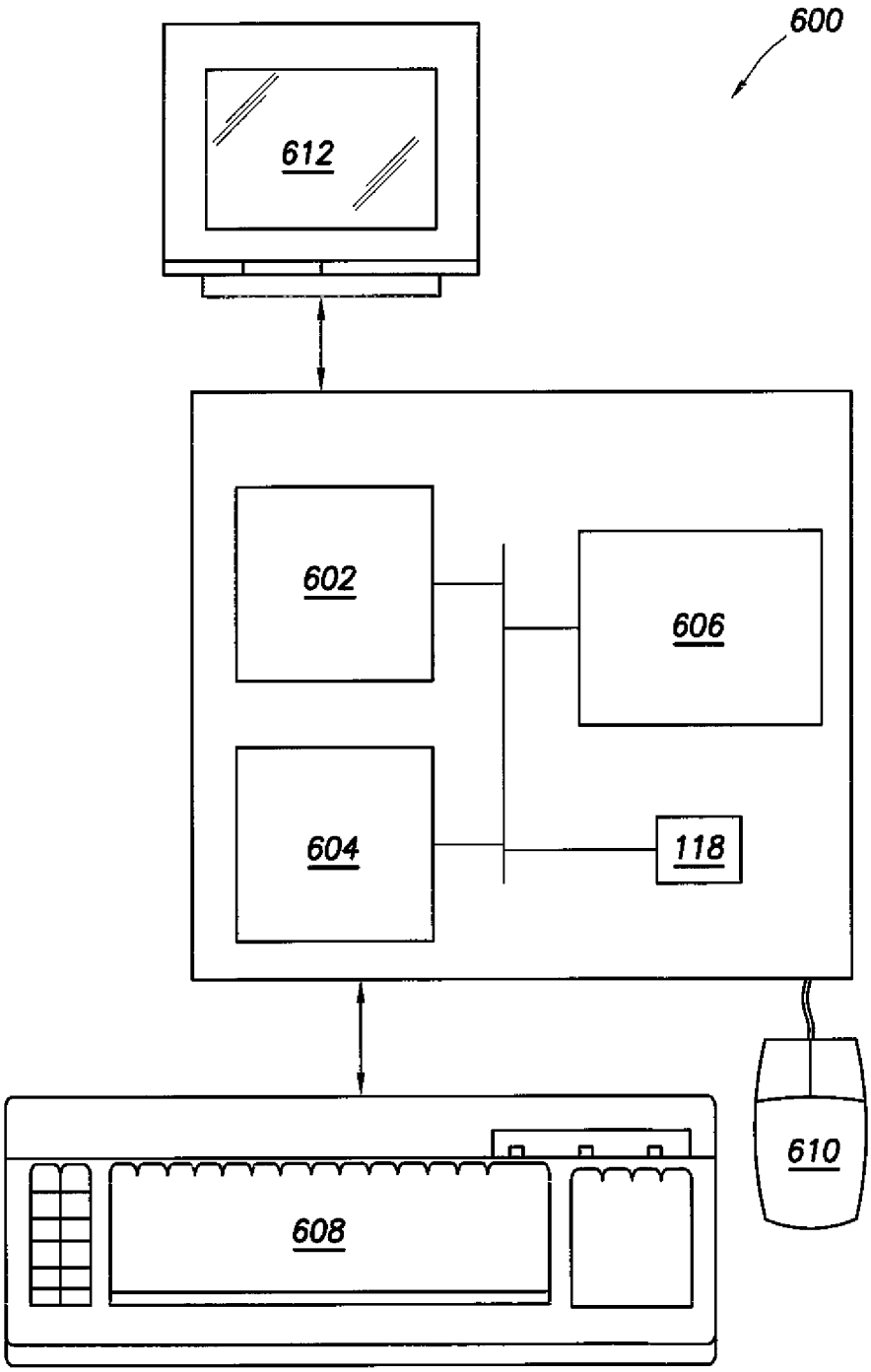
FIG. 6 depicts a schematic diagram of a computer system having the drilling operation optimization unit of FIG. 4.

FIG. 6 depicts a schematic diagram of a computer system 600 having the drilling operation optimization unit 118. The drilling operation optimization unit 118 may be implemented on any type of computer system. The computer system 600 may have a processor 602, an associated memory 604, a storage device 606, and numerous other elements and functionalities. The computer system 600 may also have one or more input devices, such as a keyboard 608 and/or a mouse 610, and an output device, such as a monitor 612. The computer system may be connected to the network 126 (as shown in FIGS. 1-3).

While the embodiments are described with reference to various implementations and exploitations, it will be understood that these embodiments are illustrative and that the scope of the inventive subject matter is not limited to them. Many variations, modifications, additions, and improvements are possible. For example, the techniques used herein may be applied across one or more wellsites in one or more fields with one or more reservoirs.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

What is claimed is:

1. A drilling operation optimization unit for a reservoir at a wellsite, comprising:

a base model unit for producing a base model of the reservoir and providing a base pre-calculation of the reservoir using the base model;

a reservoir stress unit for producing a three dimensional stress model of the reservoir and providing a stress pre-calculation of the reservoir using the stress model;

a model consolidation unit operatively connected to the base model unit and the reservoir stress unit and receiving the base model and the three dimensional stress model therefrom, the model consolidation unit merging the base model with the three dimensional stress model into a consolidated model and merging the base pre-calculation and the stress pre-calculation into a consolidated partial calculation of the reservoir using the consolidated model;

storage device coupled to the model consolidation unit to receive and store the consolidated partial calculation;

an input to receive a plurality of potential wellbore trajectories from a user; and a trajectory unit comprising a processor operatively connected to the model consolidation unit, the storage device, and the input, the trajectory unit determining at least one wellbore property based on the user selected plurality of potential wellbore trajectories and the consolidated partial calculation.

2. The drilling operation optimization unit of claim 1, wherein the trajectory unit compares the user selected plurality of potential wellbore trajectories to determine an optimal trajectory.

3. The drilling operation optimization unit of claim 2, further comprising a well plan unit determining at least one drilling parameter to be used during forming of a production wellbore along the optimal trajectory.

4. The drilling operation optimization unit of claim 3, wherein the at least one drilling parameter comprises a safe mud weight along the user selected plurality of potential wellbore trajectories.

5. The drilling operation optimization unit of claim 1, wherein the at least one wellbore property comprises wellbore stability.

6. A system for optimizing a drilling operation for a reservoir at a wellsite, the system comprising:

a drilling operation optimization unit comprising:

a base model unit for producing a base model of the reservoir and providing a base pre-calculation of the reservoir using the base model;

a reservoir stress unit for producing a three dimensional stress model of the reservoir and providing a stress pre-calculation of the reservoir using the stress model;

a model consolidation unit operatively connected to the base model unit and the reservoir stress unit and receiving the base model and the three dimensional stress model therefrom, the model consolidation unit merging the base model with the three dimensional stress model into a consolidated model and merging the base pre-calculation and the stress pre-calculation into a consolidated partial calculation of the reservoir using the consolidated model;

a storage device coupled to the model consolidation unit to receive and store the consolidated partial calculation;

an input to receive a plurality of potential wellbore trajectories from a user; and a trajectory unit comprising a processor operatively connected to the model consolidation unit, the storage device, and the input, the trajectory unit for determining at least one wellbore property based on the user selected plurality of potential wellbore trajectories and the consolidated partial-calculation; and a drilling tool for forming a wellbore along the one of the user selected plurality of potential wellbore trajectories.

7. The system of claim 6, further comprising a pumping system for pumping a mud into the wellbore.

8. The system of claim 7, wherein the at least one wellbore property comprises wellbore stability and the drilling operation optimization unit selects a safe mud weight to be pumped into the wellbore.

9. The system of claim 6, further comprising a hoisting system for running a casing string into the wellbore.

10. The system of claim 9, wherein the drilling operation optimization unit determines at least one casing point for the wellbore.

11. The system of claim 6, further comprising a controller for controlling the drilling tool.

12. A method for optimizing a drilling operation in a reservoir at a wellsite, the method comprising:

providing a drilling operation optimization unit, the drilling operation optimization unit comprising:

a base model unit for producing a base model of the reservoir and providing a base pre-calculation of the reservoir using the base model;

a reservoir stress unit for producing a three dimensional stress model of the reservoir and providing a stress pre-calculation of the reservoir using the stress model;

a model consolidation unit operatively connected to the base model and the reservoir stress unit and receiving the base model and the three dimensional stress model therefrom, the model consolidation unit merging the base model with the three dimensional stress model into a consolidated model and merging the base re-calculation and the stress pre-calculation into a consolidated partial calculation of the reservoir using the consolidated model;

a storage device coupled to the model consolidation unit;

an input to receive a plurality of potential wellbore trajectories from a user; and a trajectory unit comprising a processor operatively connected to the model consolidation unit, the storage device, and the input, the trajectory unit for determining at least one wellbore property based on the user selected plurality of potential wellbore trajectories and the consolidated partial calculation; and selecting an optimal one of the user selected plurality of potential wellbore trajectories.

13. The method of claim 12, further comprising forming a wellbore along the one of the user selected plurality of potential wellbore trajectories and wherein the at least one wellbore property comprises wellbore stability.

14. The method of claim 13, wherein the at least one wellbore property comprises a safe mud weight window, the method further comprising selecting a safe mud weight.

15. The method of claim 13, further comprising selecting a cement weight.

16. The method of claim 12, further comprising comparing the user selected plurality of potential wellbore trajectories to determine an optimal trajectory.

17. The method of claim 12, wherein the selecting further comprises the operator proximate the wellbore selecting the one of the user selected plurality of potential wellbore trajectories prior to drilling.

18. The method of claim 12, further comprising logging a test wellbore in the reservoir to build a one dimensional stress model for the reservoir.

19. The method of claim 18, further comprising propagating the one dimensional stress model throughout the reservoir to construct the three dimensional stress model.

20. The method of claim 19, further comprising constructing a finite element model for the reservoir and combining the finite element model and the three dimensional stress model.

21. The method of claim 12, further comprising inputting the user selected plurality of potential wellbore trajectories at an operator station.

* * * * *